US005211229A

United States Patent [19]

Pecue, II

[11] Patent Number: 5,211,229

[45] Date of Patent: May 18, 1993

[54] WASHPIPE SUPPORT CLAMP

[75] Inventor: William W. Pecue, II, Baton Rouge, La.

[73] Assignee: Texaco Inc., White Plains, N.Y.

[21] Appl. No.: 860,541

[22] Filed: Mar. 30, 1992

[51] Int. Cl.[5] ..... E21B 33/14; E21B 41/00

[52] U.S. Cl. ..... 166/243; 166/290; 166/382

[58] Field of Search ..... 166/208, 206, 382, 241.6, 166/241.1, 242, 243, 380, 312, 290

[56] References Cited

U.S. PATENT DOCUMENTS 2,253,675 8/1941 Arnold ..... 166/241.6
3,347,319 10/1967 Littlejohn ..... 166/290 X
3,363,688 1/1968 Bielstein ..... 166/241.1 X
3,973,630 8/1976 Wheeler et al. ..... 166/312
4,306,620 12/1981 Fronius ..... 166/241.6
4,483,395 11/1984 Kramer et al. ..... 166/241.6

*Primary Examiner*—Stephen J. Novosad
*Attorney, Agent, or Firm*—James L. Bailey; Jack H. Park; Russell J. Egan

[57] ABSTRACT

An apparatus to support washpipes has a pair of substantially mirror image components which, when clamped together about an inner string, define an annual chamber for receiving and supporting the ends of one or more washpipes.

6 Claims, 2 Drawing Sheets

WASHPIPE SUPPORT CLAMP

BACKGROUND OF THE INVENTION

1. The Present Invention

The present invention concerns a device to support washpipe in a downhole situation and, in particular to a device which will maintain concentricity during cementing operations.

2. Prior Art

When performing subsea wellhead tiebacks or mudline suspension wellhead tiebacks, it is required that certain pipe strings be reconnected to the surface in order to prepare the well for its completion. These operations require some smaller diameter pipe strings to be run through the inside of some larger diameter pipe strings. During this procedure, as well as in other special cases, it may be desirable to form an additional pressure seal by the use of a cement column between these pipe strings. This is called "grouting" the pipe annulus.

Centralization is preferred when running the smaller diameter pipe strings through the larger diameter strings to prevent the buckling of the smaller inner strings. This is accomplished by installing metal centralizers on the inner string. This helps to keep the smaller string centered inside the larger diameter pipe, by restricting lateral movement, thereby reducing the chance of buckling. In addition to reducing the buckling tendency, centralization also acts to increase the chances of obtaining a good cement bond during grouting since it offers all areas of the annulus equal opportunity for cement coverage.

The conventional method of performing a grout between casing strings calls for the running of a small pipe string (called washpipe) down the annulus formed by the casing and inner pipestring. The washpipe is normally on the order of one quarter to one eighth the diameter of the outer casing. When conditions dictate grouting large areas, it may be difficult to place cement on all sides of the annulus using a single washpipe string. The solution, of course, would be to use plural strings of washpipe. This in itself presents a problem in that unless the several washpipe strings are separated, they may all wind up on the same side of the annulus when the cement is pumped thereby decreasing the chance of a proper cement seal. To prevent this problem, centralizers may be used to restrain the relative movement of the washstrings as well as lateral movement of the inner pipe string. The major problem is that when centralization is used for the inner pipe string, it is often difficult to run even a single string of washpipe in the annulus since the washstring, in travelling downhole, may hang up on the centralizer arms.

One solution to running the washstring to the desired depth, without having to worry about its passage past the centralizers, is to simultaneously run one or more washstring(s) attached to the smaller diameter inner pipe. In other words, the grout string and the smaller diameter inner casing string are run at the same time through the larger diameter outer casing string. In the past this has been attempted using metal bands to hold the washstring onto the inner casing string. While the inner casing string can be supported by tools at the rig floor, the washpipes have no means for supporting their own weight other than through these metal bands holding them to the inner casihg string. For this reason, the metal bands must be installed relatively tightly around the washstring and the inner casing string. The problem using such metal bands occurs after the cement has been pumped and the washpipe string is being retrieved to the surface. Often these metal bands will slip to accumulate in one area as the washpipe is being pulled from the annulus. At some point during the retrieval of washpipe, the accumulation of the metal bands may be such that they bind the washpipe and prevents it from being pulled completely out of the annulus. This could result in the washpipe being cemented in the hole and the operator having to purchase this normally rented string of pipe.

SUMMARY OF THE INVENTION

The present invention is a device which will support the full weight of multiple washpipe strings while at the same time, allow for easy retrieval of the washpipe strings after a grouting operation has been completed.

BRIEF SUMMARY OF THE DRAWINGS

The present invention will now be described, by way of sample, with reference to the accompanying drawings in which.

DESCRIPTION OF THE PREFERRED EMBODIMENT

Figure 1:
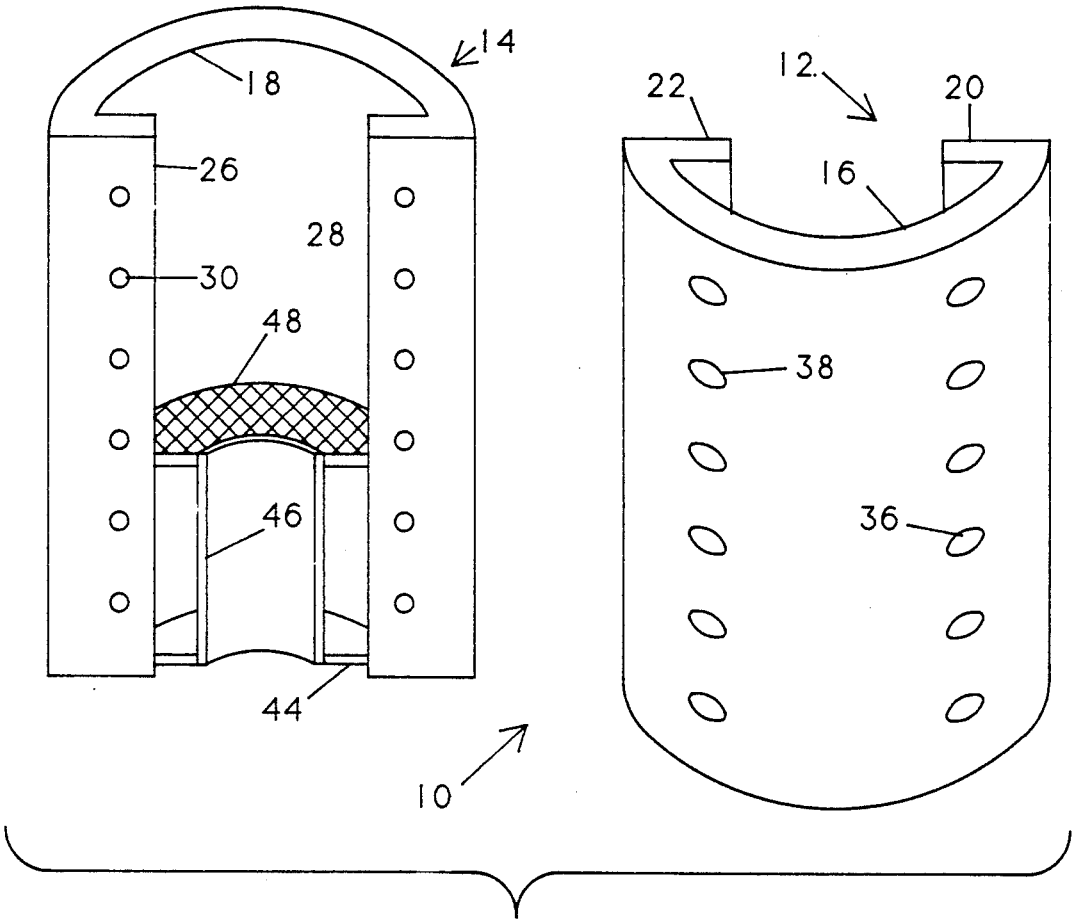
FIG. 1 is a perspective view of the present invention in a disassembled state.
Figure 2:
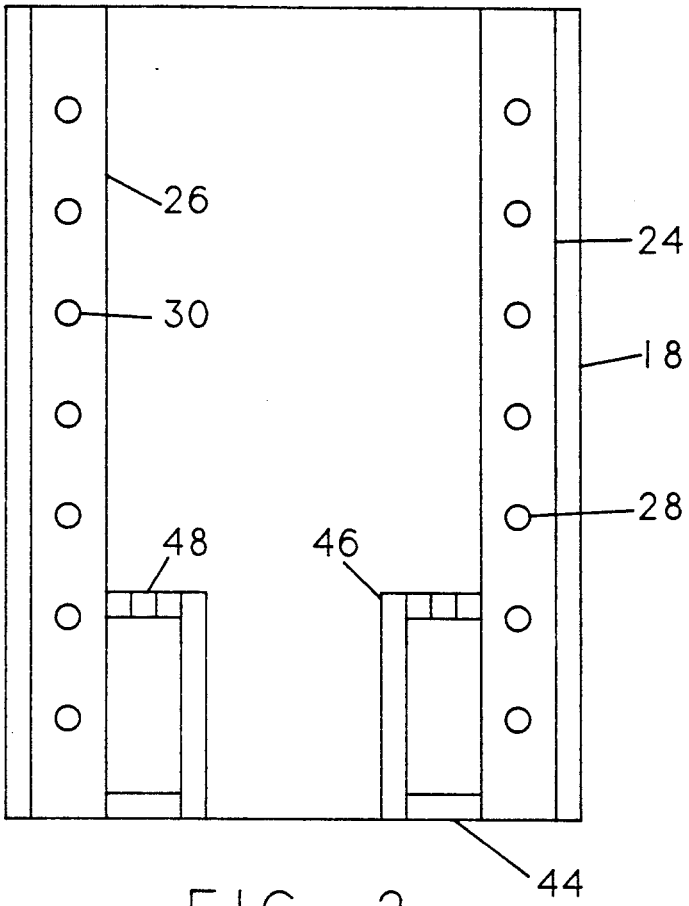
FIG. 2 is a side elevation of one half of the present invention.
Figure 3:
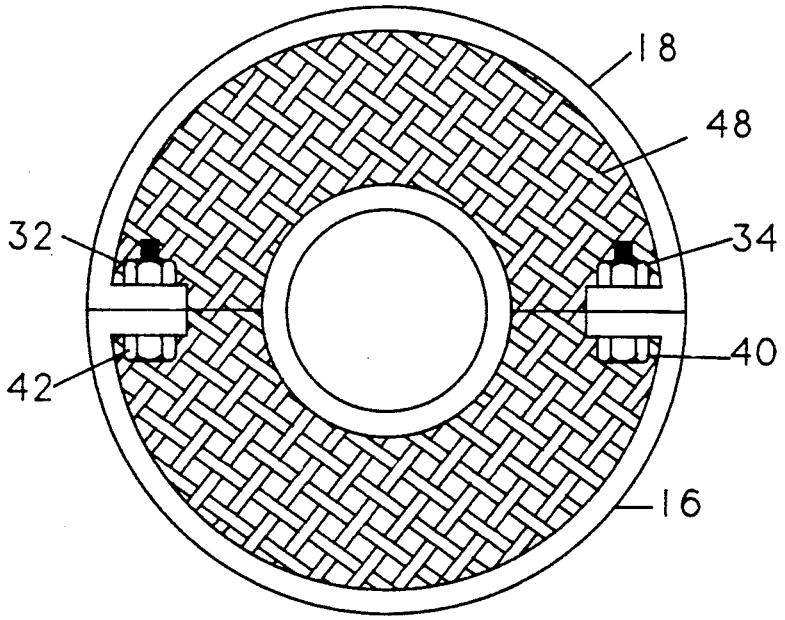
FIG. 3 is a top plan view of the present invention.

The basic design of the washpipe support clamp assembly according to the present invention ran be adapted for any size casing annulus. The subject clamp assembly 10 consists of a "split-halves" design having two substantially identical mirror-image components 12,14. Each component has a semicylindrical outer housing 16,18 with inwardly directed flanges 20,22,24,26 on the free edges thereof. The flanges are provided with a plurality of assembly bores 28,30. The bores in one component 12,14 have nuts 32,34 secured to the non mating surface of the respective flanges. The other component 12,14 has access openings 36,38 aligned with the respective bores in flanges 20,22 to receive therein bolts 40,42 to secure components 12,14 together.

A semi circular base plate 44 is secured within and at like ends of each component 12,14. The outer dimension of this base plate matches the inner dimension of the housing 16,18. The inner arcuate dimension of this base plate is slightly larger than the outer diameter of the semi cylindrical string section 46 secured to the base plate concentric within housing 16,18. The inner diameter of string section 46 is slightly larger than the outer diameter of the casing string (not shown) which will pass therethrough.

A support or expanded metal grating 48 is welded between the top of the section 46 and the inner surface of the respective housing 16,18. This grating serves to receive the ends of the washstrings and to carry their weight. By having the grating spaced from the bottom plate of the clamp, the washstrings will not have a tendency to possibly lift off the support when circulation of cement therethrough is commenced.

The subject washpipe support clamp assembly 10 can be installed on the top of any desired connection of an inner casing string. It is installed by placing the two split sections that comprise the support clamp assembly in alignment on opposite sides of the inner casing and letting the support clamp assembly sit on top of a coupling (not shown) connecting two joints of pipe. The bolts 40,42 are inserted through the access slots 36,38 to engage respective nuts 32, 34 and tightened to draw the two components together. The bottom of the washstrings (not shown) are then inserted in the annular space created by the support clamp housings 16, 18 and the outer diameter of the inner casing string (not shown). The inner casing is then run in the hole while simultaneously running the washstrings. As the casing and washstrings are run in the hole, multiblade rigid centralizers can be attached to the inner casing string at desired spaced intervals. The blades of the centralizers are oriented so that the washstrings will lie on opposite sides of the inner casing string. In addition to providing centralization for the inner casing string, these centralizers act to restrain movement of the washstrings and guarantee the vertical alignment of the washstrings.

The present invention may be subject to many modifications and changes which will be apparent to one skilled in the art. The present embodiment should therefor be considered in all respects as being illustrative and not restrictive of the scope of the invention as defined by the appended claims.

I claim:

1. Clamping means for supporting at least one washpipe in an annular space formed between an inner pipe string and an outer casing string, comprising;

two substantially mirror image components each having a semi cylindrical housing with spaced parallel end edges, flange means secured to each said end edge extending substantially radially inwardly therefrom, semi annular bottom plate means having concentric inner and outer edges and each secured to like ends of respective ones of said housings by said outer edges to extend normal to the axis of said housing, semi annular grid means having concentric inner and outer edges and each secured to respective ones of said housings extending parallel to and spaced from said bottom plates, semi cylindrical pipe string means each secured to the respective inner edges of said bottom plate and said grid means, and means to secure said components together.

2. The clamping means according to claim 1 wherein said semi cylindrical pipe string means has an inner diameter slightly large than the inner pipe string upon which the clamping means is mounted.

3. The clamping means according to claim 1 wherein the outer diameter of said housing is slightly smaller than the inner diameter of the casing string which receives said clamping means therein.

4. The clamping means according to claim 1 wherein the annular space defined by said housings and said inner pipe string is large enough to accommodate said at least one washpipe therein.

5. The clamping means according to claim I wherein said flanges have a plurality of holes arrayed therein, said means to secure said components being received therein.

6. The clamping means according to claim 5 wherein said securing means comprise, nuts means secured to said flanges of one component in alignment with the respective holes in the flange thereof, and apertures in the other of said housing means aligned with the respective holes of said flanges and receiving therein bolt means to engage with respective ones of said nut means.

* * * * *